United States Patent [19]

DeSantis

[11] 4,359,743

[45] Nov. 16, 1982

[54] BROADBAND RF ISOLATOR

[75] Inventor: Charles M. DeSantis, Neptune, N.J.

[73] Assignee: The United States of America as represented by the Secretary of the Army, Washington, D.C.

[21] Appl. No.: 260,630

[22] Filed: May 5, 1981

Related U.S. Application Data

[63] Continuation-in-part of Ser. No. 60,956, Jul. 26, 1979, abandoned.

[51] Int. Cl.[3] ..... H01Q 1/52

[52] U.S. Cl. ..... 343/792; 343/885; 333/12

[58] Field of Search ..... 343/739, 740, 790, 791, 343/792, 885, 846; 333/12

[56] References Cited

U.S. PATENT DOCUMENTS

| | | | |
|---|---|---|---|
| 2,127,088 | 8/1938 | Percival et al. | 333/12 |
| 2,237,792 | 4/1941 | Roosenstein | 343/846 |
| 2,750,589 | 6/1956 | Harris | 343/791 |
| 3,031,668 | 4/1962 | Bryson | 343/790 |
| 3,174,118 | 3/1965 | Moore | 333/12 |
| 3,428,923 | 2/1969 | Webb | 333/12 |
| 3,961,331 | 6/1976 | Campbell | 343/885 |
| 4,161,736 | 7/1979 | Goodman | 343/739 |
| 4,217,589 | 8/1980 | Stahler | 343/885 |

FOREIGN PATENT DOCUMENTS

| | | | |
|---|---|---|---|
| 1490780 | 7/1969 | Fed. Rep. of Germany | 333/12 |

*Primary Examiner*—Eli Lieberman

*Attorney, Agent, or Firm*—Nathan Edelberg; Sheldon Kanars; Jeremiah G. Murray

[57] ABSTRACT

A broadband RF isolator system for connection between RF devices such as colinear antennas is disclosed. In accordance with this invention, two or more antennas are spaced several wavelengths apart, connected to coaxial feeds and choked at their adjacent ends to establish the electrical length. In one embodiment of the invention, the isolator is formed by placing a second line adjacent the coaxial line connected to the upper antenna. The addition of this second line forms a balanced transmission line having a given characteristic impedance. The second line is terminated at one end by a resistor having a resistance equal to the value of the characteristic impedance. In a second embodiment the second line is replaced by a coaxial sleeve which is also terminated at one end with a resistor having a resistance value equal to the characteristic impedance. In four additional embodiments, which are essentially variations of the second basic embodiment, coaxial sleeves are also utilized to form the isolation system.

17 Claims, 8 Drawing Figures

BROADBAND RF ISOLATOR

The invention described herein may be manufactured, used, and licensed by or for the government for governmental purposes without the payment to me of any royalties thereon.

This application is a continuation-in-part of my copending application Ser. No. 060,956, filed July 26, 1979, now abandoned.

BACKGROUND OF THE INVENTION

This invention relates to isolators, and more particularly to isolators for isolating RF devices from one another when the cause of unwanted coupling is stray RF current flowing on the shields of coaxial lines connecting the devices together.

Unwanted coupling due to stray RF currents is very common in antenna arrays consisting of two or more single antennas stacked one above the other where each antenna must be connected to a common source. Unwanted coupling due to stray RF currents is also common in stacked or colinear antennas where each antenna must be operated in a transmit/receiver mode independently of the other antennas.

Various different systems to isolate RF devices, such as antennas, from one another when the unwanted coupling is stray RF current have been devised. An example of such a prior art system is disclosed in U.S. Pat. No. 3,879,735 issued to D. Campbell et al. In the system disclosed in this U.S. patent suppression of RF current is accomplished by using several broadband RF coaxial cable chokes on the lines connecting the antennas. The cable choke system described in the above-mentioned U.S. patent is very effective; however, the cable choke system is somewhat complicated to construct and does exhibit some frequency dispersion.

The device disclosed in U.S. Pat. No. 3,961,331 issued to D. Campbell, is an improvement of the device shown in U.S. Pat. No. 3,879,735. This improvement includes the use of damping resistors shunted across cable chokes used as isolators. These resistors broaden the attenuation characteristics of the chokes over a relatively large frequency range. By adding the shunting resistors, Campbell has decreased the quality factor or Q of the lumped resonant structure formed by the inductance and capacitance of the cable chokes. As a result, the attenuation characteristics of the cable chokes are broadened substantially over the frequency range. The U.S. Pat. No. 3,961,331 patent in FIG. 7 shows these results graphically, where in it can be seen that the addition of the shunt resistors by Campbell has substantially flattened out the attenuation characteristics over the frequency range shown.

The isolator system of this invention is an improvement of the systems disclosed in said U.S. Pat. No. 3,879,735 and U.S. Pat. No. 3,961,331 in that the isolator apparatus of this invention is relatively simple to construct, can be made more broadband, and does not exhibit frequency dispersion. Further while the invention is specifically described herein with reference to antenna systems, the isolation system of this invention can be applied wherever stray RF current suppression on shields is desired.

SUMMARY OF THE INVENTION

Two basic embodiments of the isolator system of this invention as applied to an antenna array are disclosed.

In the first embodiment, a second line is placed adjacent the coax line between the antennas. The addition of this second line causes a balanced transmission line to be formed. This balanced transmission line has a given characteristic impedance $Z_o$, is terminated at one end by a resistance equal in value to the characteristic impedance $Z_o$ and is an open line at all other points. When such a matched condition is achieved in a transmission line, then at the input of such a line the line appears to be a pure resistance equal to $Z_o$ over all frequencies. In contrast to the isolators disclosed in the aforementioned U.S. Pat. Nos. 3,879,735 and 3,961,331 the impedance of the cable chokes with or without shunting resistors, will be frequency dependent and will appear to be a pure resistor only at or near the resonant frequencies. At all other frequencies there will be frequency dispersion.

In the second basic embodiment, the added line is replaced by a coaxial sleeve that is placed around the coax line between the antennas. One end of the sleeve is terminated by a resistance having a value equal to the characteristic impedance of the coaxial line formed by the sleeve and the coax feeder line. As in the first embodiment the isolator in this embodiment will appear as a pure resistor over all frequencies.

Four embodiments in addition to the two basic embodiments are also disclosed. These four additional embodiments which also include coax sleeves, are essentially variations of the second basic embodiment.

BRIEF DESCRIPTION OF THE DRAWING

A complete understanding of the invention can be attained from the following detailed description when read in conjunction with the annexed drawing in which like parts in the various figures have like numerals and in which.

DETAILED DESCRIPTION OF THE INVENTION

Figure 1:
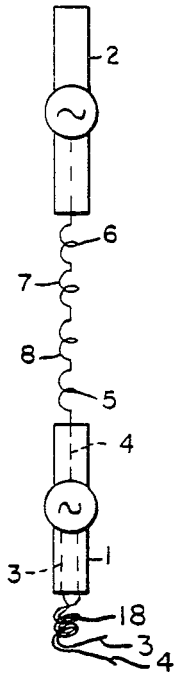
FIG. 1. (PRIOR ART)
FIG. 1 shows a prior art RF isolator.

Referring to FIG. 1, this figure illustrates the type of prior art RF isolators disclosed in previously-mentioned U.S. Pat. No. 3,879,735. The isolator is utilized to provide RF isolation between first antenna 1 and a second antenna 2. The basic antenna system, less the isolator, comprises antennas 1 and 2, the coax feeder cable 3 connected to antenna 1, the coax feeder cable 4 which passes through antenna 1 and is connected to antenna 2, a first broadband coax cable choke 5 located at the top end of antenna 1; a second broadband coax cable choke 6 located at the bottom end of antenna 2; and a third broadband cable choke 18 located at the bottom end of a antenna 1. Chokes 6, and 5 and 18 establish the electrical length of antennas 2 and 1 respectively RF isolation is provided by the broadband RF coaxial cable chokes 7 and 8 which are lumped resonant structures that exhibit a pure resistance only at or near the resonant frequency. The bandwidth of such isolators may be broadened somewhat by adding a shunting resistor across each of the chokes 7 and 8. Cable chokes 7 and 8 provide highly effective suppression of the unwanted RF currents and, therefore, the cable choke system of FIG. 1 is an effective RF isolation system.

However, construction of this cable choke system is somewhat complicated and this system does exhibit some frequency dispersion.

Figure 2:
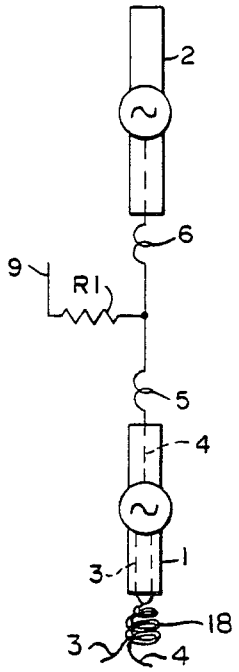
FIG. 2 shows a first embodiment of the RF isolator of this invention.

FIG. 2 shows a first embodiment of the RF isolator of this invention. In the first embodiment, cable chokes 7 and 8 of the prior art system of FIG. 1 are replaced by a line 9 that is placed adjacent coax line 4 between antennas 1 and 2. As is the case in the prior art antenna system of FIG. 1, the basic antenna system of FIG. 2 includes antennas 1 and 2, the cable chokes 5, 18, and 6 used to establish the electrical length of antennas 1 and 2 respectively and the coax feeder cables 3 and 4.

By placing line 9 in the position shown in FIG. 2, a balanced transmission line is formed. This transmission line has a characteristic impedance:

(1) $Z_o \approx 276 \text{ Log}_{10}(2D/d)$ where d is the line diameter and D is the spacing between the lines.

Current entering the outer surface of the line between the two antennas will cause substantial equal and opposite currents to flow in line 9 if a transmission line mode is set up. Normally, such transmission line currents do exist.

Line 9 should have a substantial length that is in the order of a quarter wavelength or greater at the center frequency of the antenna.

Line 9 is terminated at its lower end by the resistor R1 which has a value of resistance equal to the characteristic impedance $Z_o$ given above in equation (1). When $R1 = Z_o$, then at the input to such a line, the line appears to be a pure resistance equal to $Z_o$. Any stray currents entering one side of the line will be forced to pass through resistor R1 as if it were in series with coax cable 4. Thus, by placing line 9 adjacent coax cable 4 between antennas 1 and 2 and then terminating line 9 by means of resistor R1 which has a value equal to the characteristic impedance $Z_o$, RF isolation is achieved.

Figure 3:
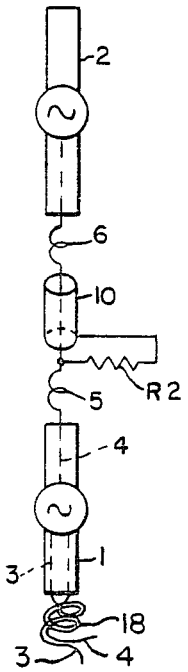
FIG. 3 shows a second embodiment of the RF isolator of this invention.

FIG. 3 shows a second embodiment of this invention. This basic antenna system in FIG. 3 is identical to the basic antenna system of FIGS. 1 and 2. In this embodiment, the RF isolator of this invention includes the sleeve 10 which is coaxial with cable 4. As compared to the first embodiment illustrated in FIG. 2, line 9 of FIG. 2 is replaced by coaxial sleeve 10. The characteristic impedance of the coaxial line formed by sleeve 10 and cable 4 is:

(2) $Z_{o1} = K \text{ Log}_e(D/d)$ where d is the diameter of the inner conductor 4, D is the diameter of the outer conductor, sleeve 10, and K is a constant depending upon the electric an magnetice properties between the lines (between sleeve 10 and cable 4)

Sleeve 10 is terminated at its lower end by the resistor R2. Resistor 2 is chosen to have a value of resistance equal to the value of the characteristic impedance $Z_{o1}$ given above in equation (2). Here again, the sleeve 10 should have a substantial length at least in the order of a quarter wavelength at the operating frequency of the antenna.

Figure 4:
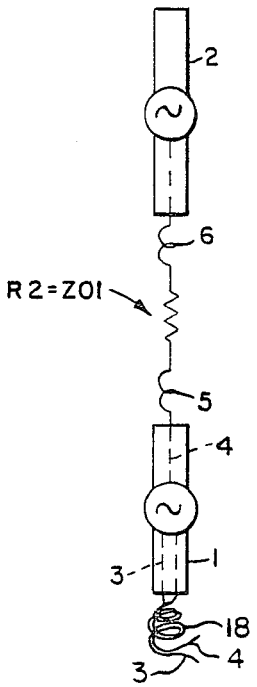
FIG. 4 is an equivalent diagram of the RF isolator of FIG. 3.

If $R2 = Z_{o1}$, the structure of FIG. 3 results in the equivalent system shown in FIG. 4. As shown in FIG. 4 the electrical equivalent system is one in which a "resistance" equal to $Z_{o1}$ is placed in series with coax cable 4 in the manner described to provide effective RF isolation. In the second embodiment illustrated in FIG. 3, coaxial sleeve 10 insures that transmission line currents will be set up on the outer sleeve 10. In the embodiments shown in FIGS. 5, 6, 7, and 8, which embodiments are variations of the embodiment of FIG. 3, sleeves are also utilized; therefore, in these embodiments the presence of transmission line current is also insured.

Figure 5:
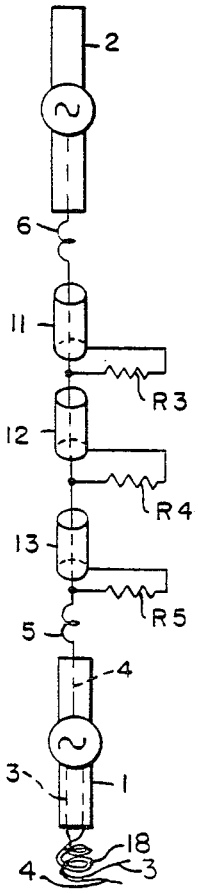
FIG. 5 shows a first variation of the RF isolator of FIG. 3.

Referring again to FIGS. 3 and 4, if one series resistor (resistor R2) is insufficient to reduce stray currents, than several sleeves, each terminated by a resistor, may be used. Such an arrangement is shown in FIG. 5. In FIG. 5 the basic antenna system is identical to the basic antenna system of the previous figures. The isolation system shown in FIG. 5 includes three coaxial sleeves, the sleeves 11, 12, and 13. Sleeve 11 is terminated at its lower end by the resistor R3, sleeve 12 is terminated at its lower end by the resistor R4 and sleeve 13 is terminated at its lower end by the resistor R5. Referring back to FIG. 4, in the electrically equivalent system of FIG. 5, the single resistor shown in FIG. 4 would be replaced by three resistors in series.

Figure 6:
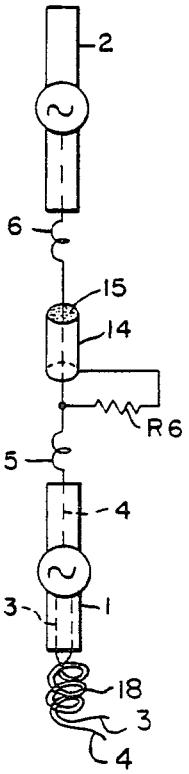
FIG. 6 shows a second variation of the RF isolator of FIG. 3.

In general, it is desirable to make $Z_{o1}$ as high as possible, within limits. If $Z_{o1}$ becomes too large, the stray current may possibly follow a lower resistance path, and thereby, almost entirely bypass the sleeve. If this occurs, the sleeve isolator wil be rendered ineffective. One way to increase $Z_{o1}$ is to increase the diameter of sleeve 10 of FIG. 3 or sleeves 11, 12, and 13 of FIG. 5 with respect to the diameter of cable 4. There are, of course, limits to this approach since too large a diameter sleeve becomes impractical. Another way to increase $Z_{o1}$ is to increase the relative permeability of the material between the sleeve since:

$Z_{o1} = \sqrt{\mu/\epsilon}$ where $\mu$ is the permeability and $\epsilon$ is the permitivity of the material. such an arrangement is shown in FIG. 6.

FIG. 6 shows the same basic antenna illustrated in the previous figures. In FIG. 6, the isolator of this invention includes the sleeve 14 which is terminated by the resistor R6. The space between sleeve 14 and cable 4 is filled with a ferrous material 15. In FIGS. 3 and 4, the medium between cable 4 and the sleeves is air. Ferrous material 15 does not have to be lossless. In fact, a lossy material will have some advantages.

Figure 7:
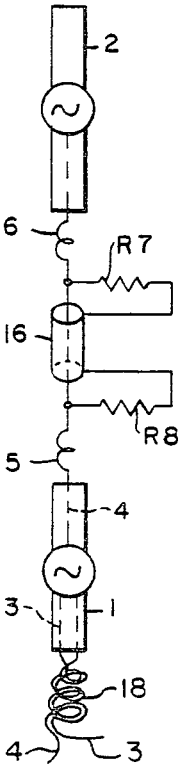
FIG. 7 shows a third variation of the RF isolator of FIG. 3.

FIG. 7 shows still another variation of the basic sleeve embodiment of FIG. 3. Again FIG. 7 shows the same basic antenna system shown in the previous figures. In this embodiment, RF isolation is provided by the coaxial sleeve 16 which is terminated at its uper end by the resistor R7 and at its lower end by the resistor R8.

Figure 8:
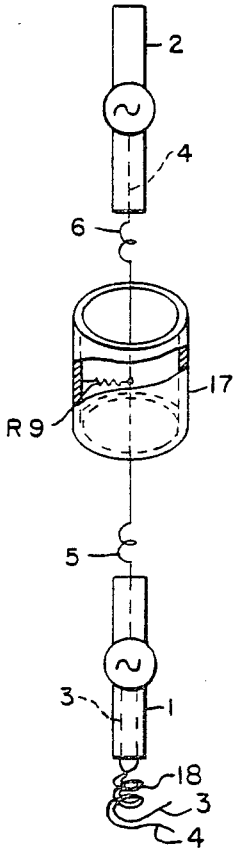
FIG. 8 shows a fourth variation of the RF isolator of FIG. 3.

FIG. 8 shows still another variation of the sleeve embodiment of FIG. 3. FIG. 8 shows the same basic antenna system shown in the previous figures. In this embodiment, RF isolation is provided by the sleeve 17 which is terminated at approximately its mid-point by the resistor R9.

While the RF isolation system of this invention is illustrated and described with reference to an antenna system having two stacked antennas, it will be apparent to those skilled in the art that the apparatus of this invention can be utilized with an antenna system having more than twostacked antennas and the system of this invention can also be utilized wherever stray RF current suppression on shields is desired. When more than two stacked antennas are provided in the antenna system, the coaxial feeds to each antenna would be bundled together to form the center conductor of the lowest sleeve or sleeves. This is another advantage of the system of this invention over the coaxial cable choke isolator of the prior art type illustrated in FIG. 1. Further, while the RF isolation system of this invention is illustrated and described with reference to various specific embodiments, it will be obvious to those skilled in the art that various changes and modifications can be made to the various embodiments without departing from the spirit and scope of the invention as set forth in the claims.

What is claimed is:

1. A broadband RF isolator system comprising:
at least one RF device;
said RF device including a conductive RF shield means for reducing the effects of RF fields on a portion of said RF device;
said RF device having means for inducing stray RF currents on the outside surface of said shield means;
isolator means coupled to said shield means for suppressing said stray RF currents;
said isolator means including a first conductor and a resistor; said first conductor and said outside surface of said shield means forming a transmission line means of substantial electrical length; and
said resistor connected between said shield means and said first conductor and having an impedance substantially equal to the characteristic impedance of said transmission line means.

2. The system according to claim 1 and wherein said means for inducing stray RF currents is an antenna.

3. The system according to claim 1 and wherein said shield means is the outside conductor of a coaxial conductor.

4. The system according to claim 3 and wherein said first conductor is a linear conductor placed parallel to and spaced from said outside conductor of said coaxial conductor.

5. The system according to claim 3 and wherein said first conductor is a coaxial sleeve placed outside and coaxial with said outside conductor of said coaxial conductor.

6. The system according to claims 4 or 5 and wherein said resistor terminates said transmission line at one point and said transmission line is open at all other points.

7. In an antenna system comprising:
at least a first and a second antenna;
said second antenna being spaced apart from said first antenna;
a first coax feeder cable connected to said first antenna and a second coax feeder cable connected to said second antenna;
said second coax feeder cable passing through said first antenna;
an RF isolator means for forming a transmission line of substantial electrical length with a linear section of said second coax feeder cable, said RF isolator means being mounted between said first and second antennas; and
resistance means connected between said means for forming a transmission line and said second coax feeder cable and having a resistance valve equal to the characteristic impedance of said transmission line.

8. In an antenna system comprising:
at least a first and a second antenna;
said second antenna being spaced apart from said first antenna;
a first coax feeder cable connected to said first antenna and a second coax feeder cable connected to said second antenna;
said second coax feeder cable passing through said first antenna;
an RF isolator means including a line section placed adjacent and parallel to said second coax feeder cable between said first and second antennas, said transmission line being formed by said line section and said second coax feeder cable being a balanced transmission line; and
a resistor having a resistance value equal to the characteristic impedance of said transmission line connected between one end of said line section and said second coax feeder cable.

9. An RF isolator as defined in claim 7 wherein said means for forming a transmission line with said second coax feeder cable is a sleeve, said sleeve being mounted such that it surrounds at least a part of the length of said second coax feeder cable between said first and second antennas, said sleeve being coaxial with said second coax feeder cable, said transmission line formed by said sleeve with said second coax feeder cable being a coax transmission line, and wherein said resistance means is a resistor connected between said sleeve and said second coax feeder cable.

10. An RF isolator as defined in claim 7 wherein a ferrous material is located between said second coax feeder cable and said sleeve.

11. An RF isolator as defined in claim 7 wherein said means for forming a transmission line with said second coax feeder cable comprises a plurality of sleeves, said sleeves being mounted such that each sleeve surrounds a portion of the length of said second coax feeder cable between said first and second antennas, said plurality of sleeves being spaced coaxially along the length of said second coax feeder cable between said first and second antennas, and wherein said resistance means comprises a plurality of resistors equal in number to the number of said plurality of sleeves, a different one of said plurality of resistors being connected between each one of said plurality of sleeves and said second coax feeder cable.

12. A broadband antenna system for at least first and second radio apparatus adapted to operate simultaneously in relative close proximity, comprising in combination:
at least two dipole antennas, each including a pair of tubular radiating elements, respectively coupled to said first and second radio apparatus, said antennas being mounted one above the other and having a predetermined spacing therebetween with said respective pairs of radiating elements being aligned generally along a common vertical axis;
a first coaxial transmission feedline coupling said first radio apparatus to the upper dipole antenna, running through the pair of radiating elements of said lower dipole antenna and the lower radiating element of said upper dipole antenna and additionally being configured to provide a first cable choke section adjacently below the lower radiating element of the upper dipole antenna, a second cable choke section adjacently above the radiating element of the lower dipole antenna, and a third cable choke section adjacently below the lower radiating element of the lower dipole antenna;

a second coaxial transmission feedline coupling said second radio apparatus to the lower dipole antenna, being fed through the lower radiating element thereof, and configured to provide a fourth cable choke section adjacently below the lower radiating element of said lower dipole antenna;

an RF isolator comprising a third transmission line means of substantial electrical length coupled to said first transmission feedline intermediate said first and second cable choke sections, the third transmission line means being formed from a straight part of the first transmission feedline between said first and second cable choke sections and at least one additional element, the lengthwise direction of said at least one additional element and said straight part of the first transmission feedline being parallel, and resistance means connected between said at least one additional element and said first transmission feedline said resistance means having a value substantially equal to the value of the characteristic impedance of the third transmission line.

13. The antenna system as defined in claim 12, wherein said additional element is a line section placed adjacent the first transmission line means to form a balanced transmission line, said line section being of the same outer diameter as the first transmission line means, and wherein said resistance means is a resistor connected between one end of said line section and the first transmission line means.

14. The antenna system as defined in claim 12, wherein said additional element comprises sleeve means mounted such that it surrounds said part of the length of said first transmission feedline between said first and second cable choke sections.

15. The antenna system as defined by claim 14, wherein said sleeve means is a single sleeve, and wherein said resistance means is a resistor connected between the sleeve and the first transmission feedline.

16. The antenna system as defined by claim 14, wherein said sleeve means comprises a plurality of sleeves, and wherein said resistance means comprises a plurality of resistors equal in number to the number of sleeves, a different one of said plurality of resistors being connected between each one of said plurality of sleeves and said first transmission feedline.

17. The antenna system as defined by claims 14, wherein a ferrous material is located between said first transmission feedline and said sleeve means.

* * * * *